US007712495B1

(12) United States Patent
Hurst

(10) Patent No.: US 7,712,495 B1
(45) Date of Patent: May 11, 2010

(54) MACHINE FOR FORMING A POINT ON WOODEN STAKES

(76) Inventor: Marlin J. Hurst, 536 N. Shirk Rd., New Holland, PA (US) 17557

( * ) Notice: Subject to any disclaimer, the term of this patent is extended or adjusted under 35 U.S.C. 154(b) by 936 days.

(21) Appl. No.: 11/151,128

(22) Filed: Jun. 13, 2005

(51) Int. Cl.
*B27H 5/00* (2006.01)
*B27M 3/00* (2006.01)

(52) U.S. Cl. ..... 144/360; 144/12; 144/30; 144/181.3

(58) Field of Classification Search ..... 144/30, 144/141, 142, 143, 12, 181.3, 168–171, 242.1, 144/359, 360
See application file for complete search history.

(56) References Cited

U.S. PATENT DOCUMENTS

| | | | | | |
|---|---|---|---|---|---|
| 2,170,687 | A * | 8/1939 | Johnson | 144/135.3 |
| 3,073,362 | A | 1/1963 | Bourdon | 144/30 |
| 3,111,971 | A | 11/1963 | Spencer | 144/30 |
| 3,190,325 | A | 6/1965 | Mood | 144/30 |
| 3,403,710 | A | 10/1968 | Garrison | 144/30 |
| 3,451,449 | A | 6/1969 | Bouma | 144/30 |
| 3,719,216 | A * | 3/1973 | Tracy | 83/471.2 |
| 4,100,949 | A * | 7/1978 | Carter | 144/402 |
| 4,238,983 | A * | 12/1980 | Westmoreland | 83/408 |
| 4,387,751 | A | 6/1983 | Carter | 144/30 |
| 5,109,896 | A | 5/1992 | Tomes | 144/30 |
| 5,343,911 | A * | 9/1994 | Humphrey | 144/134.1 |
| 5,638,877 | A | 6/1997 | April | 144/30 |
| 6,364,093 | B1 * | 4/2002 | LaBolt | 198/775 |
| 6,817,392 | B2 * | 11/2004 | Phillips | 144/39 |
| 7,093,628 | B2 * | 8/2006 | Kelly et al. | 144/360 |

* cited by examiner

*Primary Examiner*—Shelley Self
(74) *Attorney, Agent, or Firm*—Miller Law Group, PLLC

(57) ABSTRACT

A wooden stake sharpening machine moves a conical cutting head along a linear path into engagement with a clamped wooden stake blank to affect sharpening thereof. A walking beam conveying apparatus moves a wooden stake blank into position from a supply bin where a clamping apparatus holds the stake blank in place while the cutting head moves onto the stake to form a point thereon. The drive mechanism moves the conveyor in coordination with the linear movement of the cutting apparatus, which trips a switch to actuate the clamping mechanism as the cutting head moves toward engagement with the stake blank. The conveyor then moves the sharpened stake toward a collection area while moving another stake blank into position for sharpening as the cutting apparatus is retracted away from the stake, thus providing an automated stake sharpening machine with a minimal number of moving parts.

20 Claims, 10 Drawing Sheets

Fig. 7
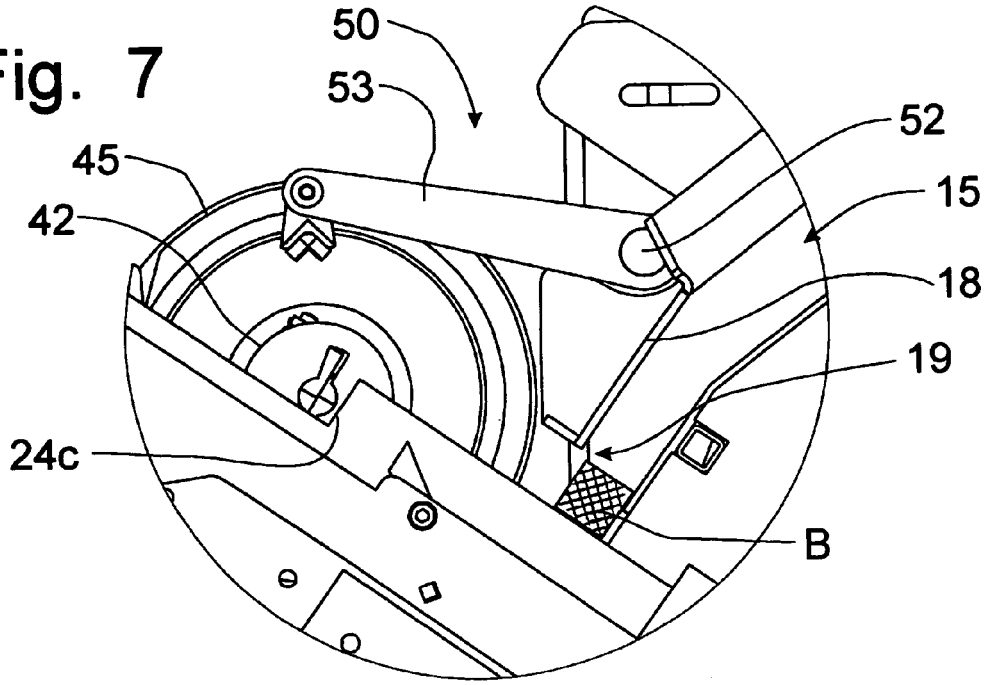
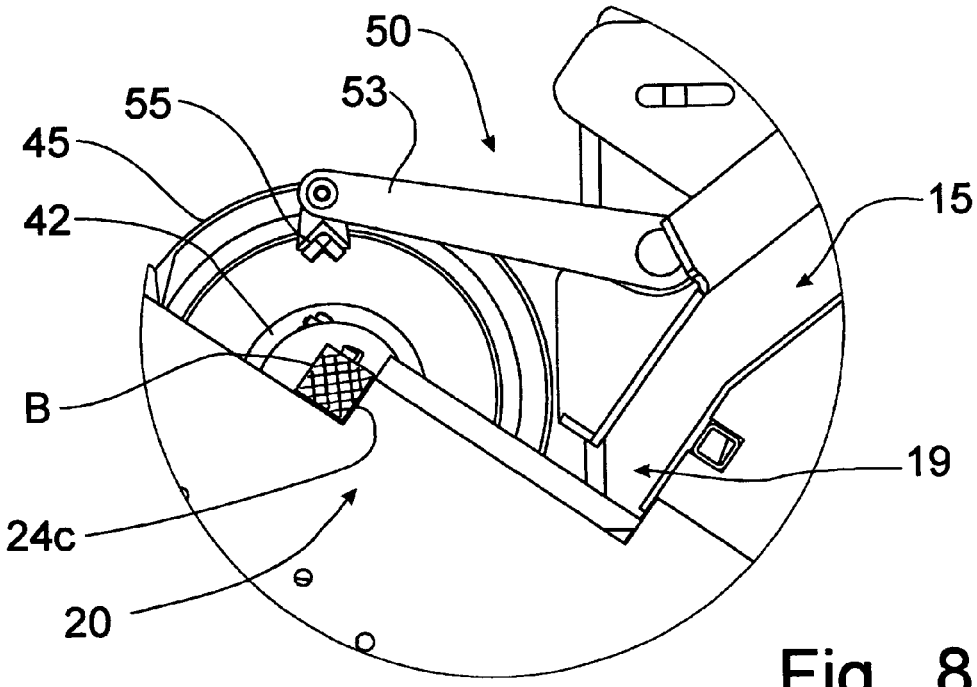
Fig. 8

Fig. 9
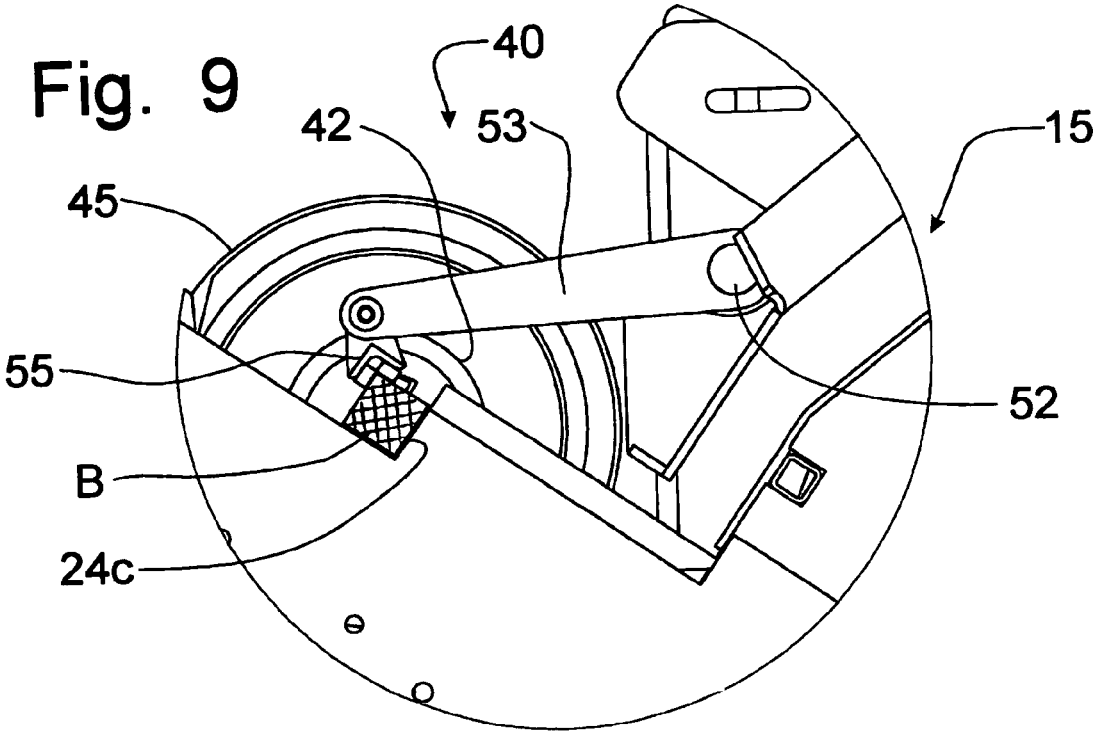
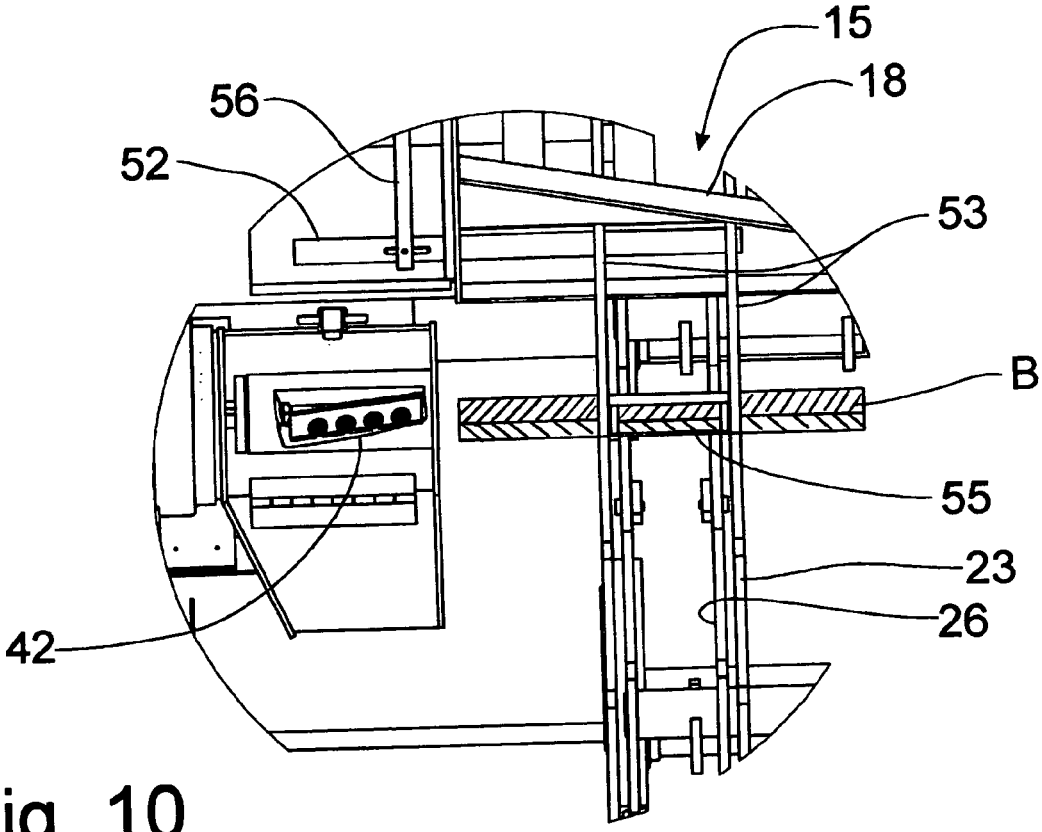
Fig. 10

Fig. 13
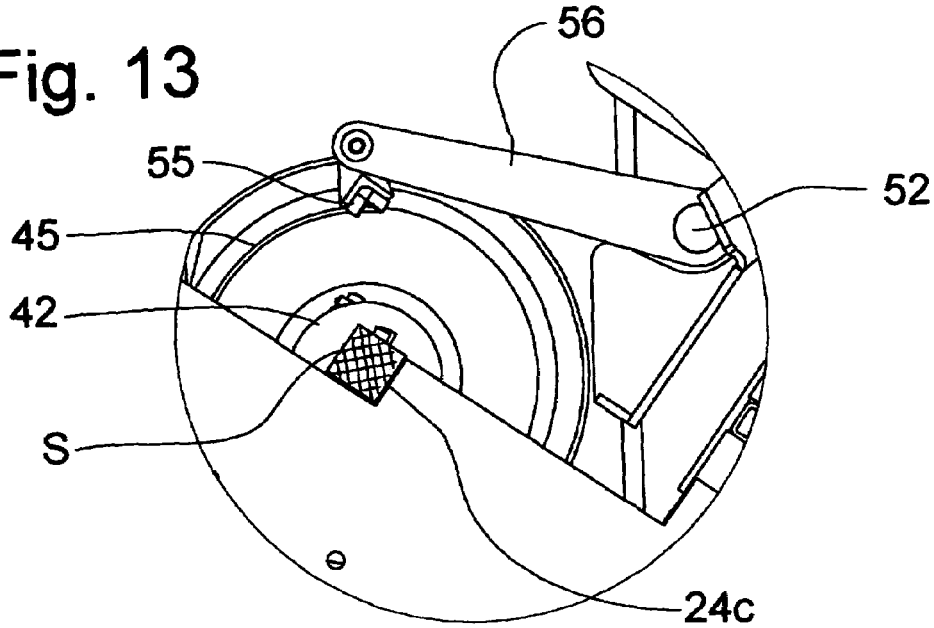
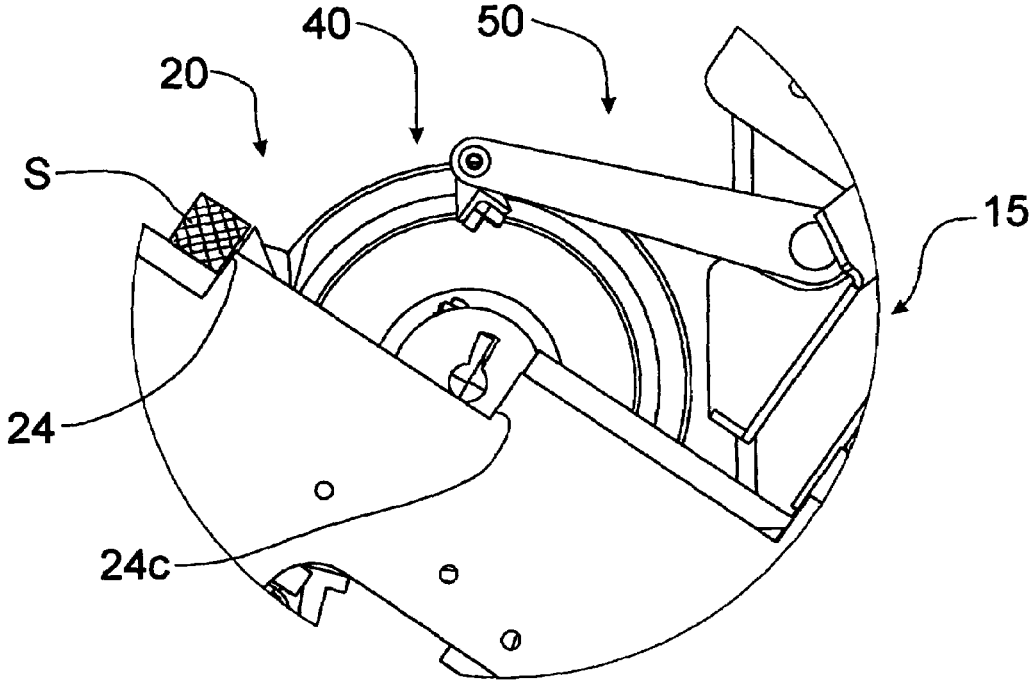
Fig. 14

MACHINE FOR FORMING A POINT ON WOODEN STAKES

BACKGROUND OF THE INVENTION

The present invention relates generally to a machine for sharpening a point on wooden stakes, and, more particularly, to an apparatus that receives a supply of unsharpened wooden stakes and automatically forms a sharpened point thereon.

Wooden stakes are driven into the ground for a plurality of purposes, including fencing support, agricultural crop support, and survey and grade markers in construction. The stakes are formed on a cutting machine that forms the wooden stake in the required dimensions, whereupon the formed wooden blank is then transferred to another machine to form a point at one end to facilitate the driving of the stake into the ground. A number of different machines have been devised to form the sharpened point. Such machines are typically configured to move the wooden stake blank into the path of a cutting or chipping device that cuts away the wood along an angular path to form the customary point.

Such machines can be manually operated, as can be seen in U.S. Pat. No. 3,111,971, issued to Elbert Spencer on Nov. 26, 1963, in which a post blank can be inserted into a receiving tube into engagement with an angularly oriented chipping head that cuts away the wooden material at the end of the post to create a point thereon. In U.S. Pat. No. 5,109,896, issued to Christopher Tomes on May 5, 1992, and in U.S. Pat. No. 5,638,877, granted to Norman Apr. on Jun. 17, 1997, the wooden stake blank is manually inserted against a guide fence or tube into engagement with a chipping head to form the sharpened point, wherein the guide fence or tube is positioned at an angular orientation to the chipping head.

Wooden posts are also presented to machines to affect the sharpening of an end thereof, as can be seen in U.S. Pat. No. 3,073,362, granted to Simon Bourdon on Jan. 15, 1963, and in U.S. Pat. No. 3,403,710, granted to Richard Garrison on Oct. 1, 1968, in which the wooden post blank is manually presented into a conical chipping head to remove the wooden material at one end of the wooden post blank to form a point thereon. In U.S. Pat. No. 3,451,449, issued to Harold Bouma on Jun. 24, 1969, the wooden post blank is reciprocally moved into engagement with a conical cutterhead at each respective end of the machine to form a point and a cap at the opposite ends of the wooden post. Similarly, the machine disclosed in U.S. Pat. No. 4,387,751, granted to Charles Carter on Jun. 14, 1983, forms a point of wooden pickets by moving the picket blank into engagement with an abrading apparatus to remove the material at the end of the wooden picket blank.

The stake point machine disclosed in U.S. Pat. No. 3,190,325, granted to Elmer Mood on Jun. 22, 1965, operates a little differently in that the wooden stake blanks are aligned on a horizontal conveyor and clamped into a fixed position while a shearing head moves vertically into engagement with the wooden stake blank to sever wooden material away from the stake blank to form the point. The shearing head moves in conjunction with a V-shaped striker to affect the shearing of the material away from the stake blank. The conveyor advances sequentially to move the stake blanks into alignment with the striker member to be sheared into a point.

Presently commercially available stake pointing machine operate on a reciprocal basis to move a wooden stake blank into engagement with a cutting or chipping apparatus to form the point at the end of the stake. As can be seen in the know prior art references described above, the stakes can be manually handled to affect the sharpening process or in an automated manner in which the stake is clamped or fixed against a support and then moved into engagement with the cutting or chipping apparatus.

Such complex reciprocation equipment for the stake requires frames, clamping supports and linear actuators to affect the reciprocal movement of the stakes. It would be desirable to provide a less complex and less expensive stake pointing apparatus for use in industry to provide mass quantities of sharpened wooden stakes in an automated fashion.

SUMMARY OF THE INVENTION

It is an object of this invention to provide a machine for forming a point on wooden stakes that clamps the wooden stake blank and moves the cutting apparatus into engagement with the clamped wooden stake blank.

It is a further object of this invention to provide an effective automated process for sharpening wooden stakes.

It is a feature of this invention that the stake pointing machine can perform an automated sharpening of wooden stakes with a minimal number of moving parts.

It is as advantage of this invention that the stake sharpening machine can be manufactured at less cost than heretofore known in the industry.

It is another feature of this invention that the cutting head operable to form a point on the wooden stake is move into engagement with the wooden stake blank clamped on the support table.

It is still another feature of this invention that a walking beam transports the sharpened wooden stakes to a stacking apparatus for removal from the stake sharpening machine.

It is yet another feature of this invention that the primary drive apparatus causes a coordinated movement of the clamping apparatus, the movement of the cutting apparatus, and the movement of the conveying apparatus to affect a sharpening of wooden stakes in a sequential manner.

It is another advantage of this invention that the cutting apparatus is adjustably mounted on a subframe to permit positional movement thereof to accommodate different sized wooden stake blanks.

It is still another advantage of this invention that the cutting apparatus is formed with a conical chipping head that is moved axially into engagement with a wooden stake blank to affect sharpening thereof.

It is yet another feature of this invention that the walking beam conveyor sequentially moves the wooden stakes from a supply bin, to the sharpening station and to a remote collection area for stacking and shipping the sharpened wooden stakes.

It is still another feature of this invention that a switch engaged by the moving subframe supporting the cutting apparatus automatically trips actuation of a pneumatic or hydraulic cylinder to cause the clamping apparatus to engage the wooded stake blank before being engaged by the cutting apparatus.

It is yet another object of this invention to provide a wooden stake sharpening apparatus that is durable in construction, inexpensive of manufacture, carefree of maintenance, facile in assemblage, and simple and effective in use.

These and other objects, features and advantages are accomplished according to the instant invention by providing a wooden stake sharpening apparatus in which the conical cutting head is moved linearly along a path into engagement with a clamped wooden stake blank to affect sharpening thereof. A walking beam conveying apparatus moves a wooden stake blank into position from a supply bin where a clamping apparatus holds the stake blank in place while the cutting head moves onto the stake to form a point thereon. The drive mechanism moves the conveyor in coordination with the linear movement of the cutting apparatus, which trips a switch to actuate the clamping mechanism as the cutting head moves toward engagement with the stake blank. The conveyor then moves the sharpened stake toward a collection area while moving another stake blank into position for sharpening as the cutting apparatus is retracted away from the stake, thus providing an automated stake sharpening machine with a minimal number of moving parts.

BRIEF DESCRIPTION OF THE DRAWINGS

The foregoing and other objects, features, and advantages of the invention will appear more fully hereinafter from a consideration of the detailed description that follows. It is to be expressly understood, however, that the drawings are for illustrative purposes and are not to be construed as defining the limits of the invention.

FIG. 7 is a partial end elevational view of the sharpening station and adjacent structure with a wooden stake blank at the bottom of the supply bin ready to be moved to the sharpening station;

FIG. 8 is a partial end elevational view of the sharpening station and surrounding structure with the wooden stake blank being moved by the conveyor through the opening in the supply bin to the sharpening station;

FIG. 9 is partial end elevational view of the sharpening station and surrounding structure with the wooden stake blank positioned in the sharpening station, the cutterhead having been moved to trip the trip switch for the clamping apparatus so that the clamping member moves into engagement with the wooden stake blank;

FIG. 10 is a partial top plan view of the sharpening station and surrounding structure corresponding to the view of FIG. 9 with the chipping device moving into engagement with the wooden stake blank;

FIG. 13 is a partial end elevational view of the sharpening station and surrounding structure with the wooden stake blank being positioned at the sharpening station but disengaged by the clamping apparatus due to the cutterhead moving a sufficient distance to release the trip switch; and FIG. 14 is a partial end elevational view of the sharpening station and surrounding structure with the sharpened wooden stake being moved upwardly to the next saw tooth stop by the conveyor, at which time the next wooden stake blank would be positioned on the sharpening station by the conveyor.

DETAILED DESCRIPTION OF THE PREFERRED EMBODIMENT

Figure 1:
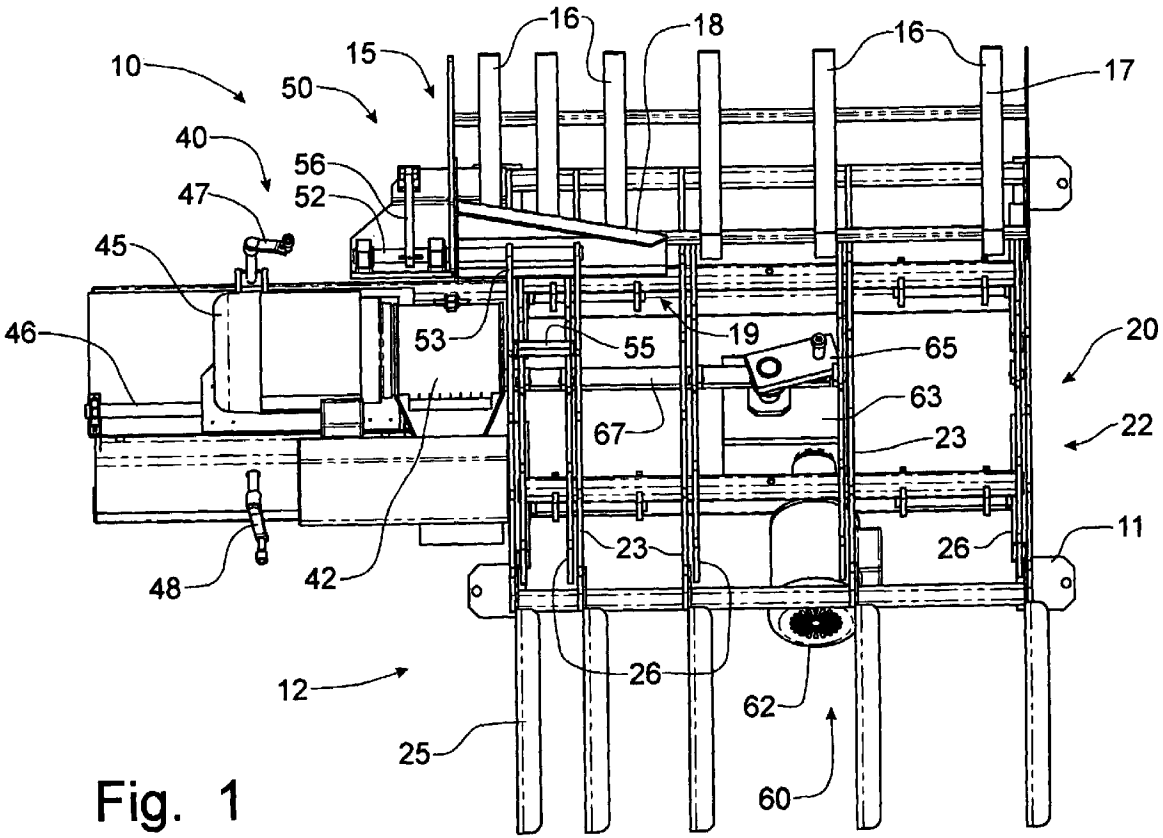
FIG. 1 is a top plan view of a wooden stake sharpening machine incorporating the principles of the instant invention, the cutting head being moved into a stake engaging position by the drive mechanism.

Referring to FIGS. 1-5, a stake sharpening machine incorporating the principles of the instant invention can best be seen. The stake sharpening machine 10 has a frame 11 supporting a drive mechanism 60, a cutting apparatus 40, a supply bin 15, and a conveyor device 20 for moving the wooden stakes from the supply bin 15 to the delivery table 25 opposite the supply bin 15. The supply bin 15 is formed by a series of plate members 16 forming an angled wall 17 that feeds wooden stake blanks B, best seen in FIGS. 7-12, by gravity to the bottom of a restrictor plate 18 that funnels the wooden stake blanks B to an opening 19 at the bottom of the supply bin 15 that will accommodate a single wooden stake blank B. Preferably, the wooden stake blanks B are stacked along the angled wall 17 in a manner to prevent a congestion of wooden stake blanks B along the restrictor plate 18, thus permitting a smooth flow of blanks B through the opening 19, as will be described in greater detail below.

The walking beam conveyor 20 is best depicted in FIGS. 1-6*d*. The conveyor 20 is utilized in conjunction with a saw tooth base member 22 that is fixedly secured to the frame 11 of the machine 10. The saw tooth base member 22 is formed of a plurality of individual saw tooth fins 23 located on the delivery side 12 of the machine 10 to convey sharpened stakes S to the delivery table 25 positioned at the top of the base member 22 to receive the conveyed sharpened stakes S. The conveyor 20 includes a saw tooth conveyor fin 26 corresponding to each of the base member fins 23, each conveyor fin 26 being formed in a configuration conforming to the base member fins 23 and being positioned adjacent thereto. One skilled in the art will readily recognize that the conveyor fins 26 are mounted in parallel with one another and are moved together as a unit.

As is best seen in the schematic diagrams of FIGS. 6*a* through 6*d*, the conveyor fins 26 are mounted for circular motion relative to the base member fins 23. The drive apparatus for rotating the conveyor fins 26 is represented by the circle 29. Looking first at FIG. 6*a*, the motion of the conveyor fins 26 is demonstrated by the respective phantom representation of the conveyor fin 26 as the fin 26 moves around the circular arc. At FIG. 6*b*, the movement of the conveyor fins 26 to engage a stake positioned on one of the saw tooth stops 24 on the base member fins 23 is represented by the dashed conveyor fin 31. The saw tooth configuration of the conveyor fins 26 register with the base member fins 23. Movement of the drive apparatus 29 pulls the conveyor fins 26 upward and forwardly to the position depicted by the conveyor fin 33 in phantom lines. Since the conveyor fins 26 move upwardly relative to the base member fins 23, the sharpened stake is lifted accordingly by the conveyor fins 26 above the base member 22. Further rotation of the drive apparatus 29 moves the conveyor fins 26 forwardly along the arc of movement 29 to the position shown by the conveyor fin 35 in solid lines.

Figure 6B:
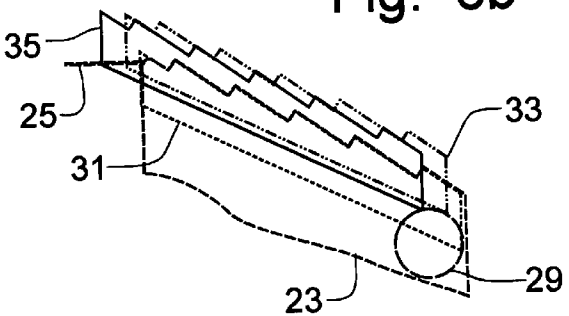
FIG. 6*b* is a schematic representation of the walking beam conveyor depicting the lifting of an object from the base member to move the object up the base member.
Figure 6A:
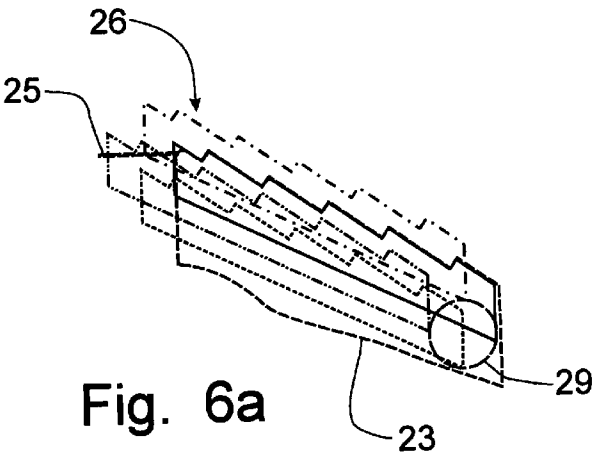
FIG. 6*a* is a schematic representation of the walking beam conveyor demonstrating the operation of the conveyor.
Figure 6C:
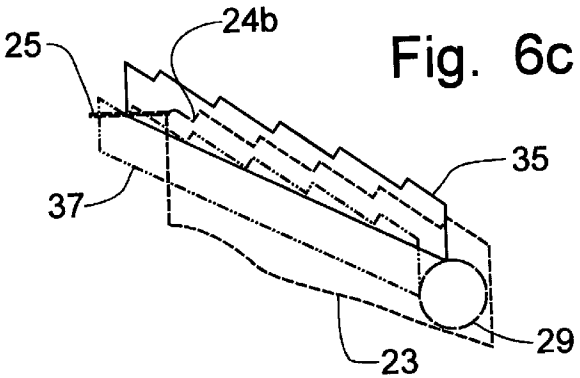
FIG. 6*c* is a schematic representation of the walking beam conveyor depicting the operation of the conveyor to push an object positioned on the delivery table.
Figure 6D:
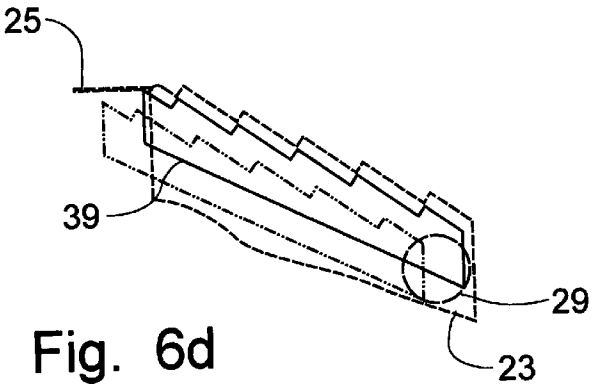
FIG. 6*d* is a schematic representation of the walking beam conveyor showing the return of the waling beam to be positioned beneath the positions depicted in FIG. 6*b;*

The continued rotational movement of the conveyor fins 26 ultimately reaches the position of the fin 37 in phantom lines in FIG. 6*c*. When the conveyor fins 26 pass below the level of the base member 22, the sharpened stake is deposited back on the base member at the saw tooth stop 24*a*, which is the stop located one step higher on the base member fins 23 than the previous stop 24 on which the sharpened stake had been located. Continued rotational movement of the conveyor fins 23, as demonstrated in FIG. 6*d*, returns the conveyor fins 26 to the position depicted by the conveyor fin 39 in solid lines in FIG. 6*d* at which point the conveyor fins 26 have been returned to a location immediately below the dashed line position 31 of FIG. 6*b*.

Continued rotation of the drive apparatus 29 progresses the sharpened stake up the base member fins 23 one saw tooth stop 24 at a time until the sharpened stake reaches the delivery table 25. As can be seen in the conveyor fin 37 in phantom in FIG. 6*c*, the sharpened stake that had been positioned at the uppermost saw tooth stop 24*b* would now be deposited on the delivery table 25 when the conveyor fins 26 reach the position 37. Looking at the advancing of the conveyor fins 26 from the phantom position 33 in FIG. 6*b* to the solid line position 35 and then to the phantom line position 37, one skilled in the art will recognize that the sharpened stake, previously deposited on the delivery table 25 on the prior rotational cycle, would be pushed outwardly by the movement of the conveyor fins 26. Accumulated sharpened stakes on the delivery table 25 can then be handled manually or with separate machine to box or package the stacks in appropriate bundles for shipping to the customer.

The cutterhead 40 is formed as a conical chipping device 42 into which a stake blank can be inserted axially to obtain the formation of a point on the end of the stake, not wholly unlike the operation of a conventional pencil sharpened. The conical chipping device 42 is operably connected to a motor 45, preferably an electric motor that is operable to generate sufficient power to chip wood away from the stake blanks in a rapid manner for efficient production. The cutterhead 40 is reciprocally mounted on linear rails 46 for movement toward and away from the base member 22. Preferably, the electric motor 45 moves with the chipping device 42 in reciprocating toward and away from the stake blank with wires (not shown) delivering electrical current thereto being mounted in a conventional manner to allow for the reciprocating movement.

The position of the rails 46 is selectively movable to affect a precise positioning of the open throat of the chipping device 42. More particularly, a vertical movement of the rails 46, and thus the cutterhead 40 can be accomplished through manipulation of the adjustment lever 47 and the accompanying linkage supporting the linear rails 46 and the cutter head 40. Similarly, the horizontal alignment of the cutterhead 40 can be accomplished through the selective manipulation of the adjustment lever 48. By appropriate utilization of the position adjustment levers 47, 48, the throat of the chipping device 42 can be properly positioned and repositioned to correspond to differently sized wooden stake blanks so that the throat of the chipping device 42 is properly aligned with the stake blank, irrespective of the dimensions thereof.

A clamping apparatus 50 is pivotally mounted next to the reciprocating cutterhead 40 to restrain the wooden stake blank in place on the lowermost saw tooth stops 24*c* on the base member fins 23 while the chipping device 42 is advanced into engagement with the unsharpened end of the stake blanks. The clamping apparatus 50 is formed as a rock shaft 52 rotationally mounted on the frame 11 of the machine 10. Projecting from the rock shaft 52 toward the cutterhead 40 are a pair of clamp arms 53 that have mounted on the distal ends thereof a length of angle iron forming the clamping member 55 that is movable into engagement with a stake, as will be described in greater detail below. An actuator arm 56 projects from the rock shaft 52 away from the cutterhead 40 for engagement with a linear actuator 57, such as, preferably, a pneumatic cylinder or a hydraulic cylinder. The stroke of the linear actuator 57 can be varied in known manners to selectively locate the clamping position of the clamping member 45 to correspond to differently sized stakes being sharpened. The linear actuator 57 is operatively powered through an appropriate supply of air under pressure, or to a hydraulic system (not shown) providing hydraulic fluid under pressure to the actuator 57 for operation thereof.

A trip switch 59 is position on the adjacent rail 46 for the cutterhead 40 so that any movement of the cutterhead 40 into engagement with the trip switch 59 triggers the actuation of the linear actuator 57 in response to the movement of the cutterhead 40 along the rails 46. For example, a forward movement of the cutterhead 40 along the slide rails 46 trips the switch 59 to cause an extension of the actuator 57 causing the actuator arm 56 to raise and a corresponding rotation of the rock shaft 52. This rotational movement of the rock shaft 52, in turn, causes the clamping arms 53 to move downwardly, driving the clamping member 55 into a clamping engagement of the stake positioned on a support table, which preferably may also be the lowermost saw tooth stop 24*c* on the base members 23.

After sharpening the end of the clamped stake, the cutterhead 40 is reciprocated away from the stake just sharpened, again tripping the switch 59 to cause the linear actuator 57 to contract. This contraction of the linear actuator 57 causes a lowering of the actuator arm 56, and a resultant raising of the clamping member 55 to release the sharpened stake for movement up the conveyor apparatus 20 as described above. Thus, the clamping of the stake blank to resist the forces asserted on the stake blank by the rotating chipping device 42 is automatically initiated in response to the cutterhead 40 moving toward the stake blank for engagement thereof.

Figure 2:
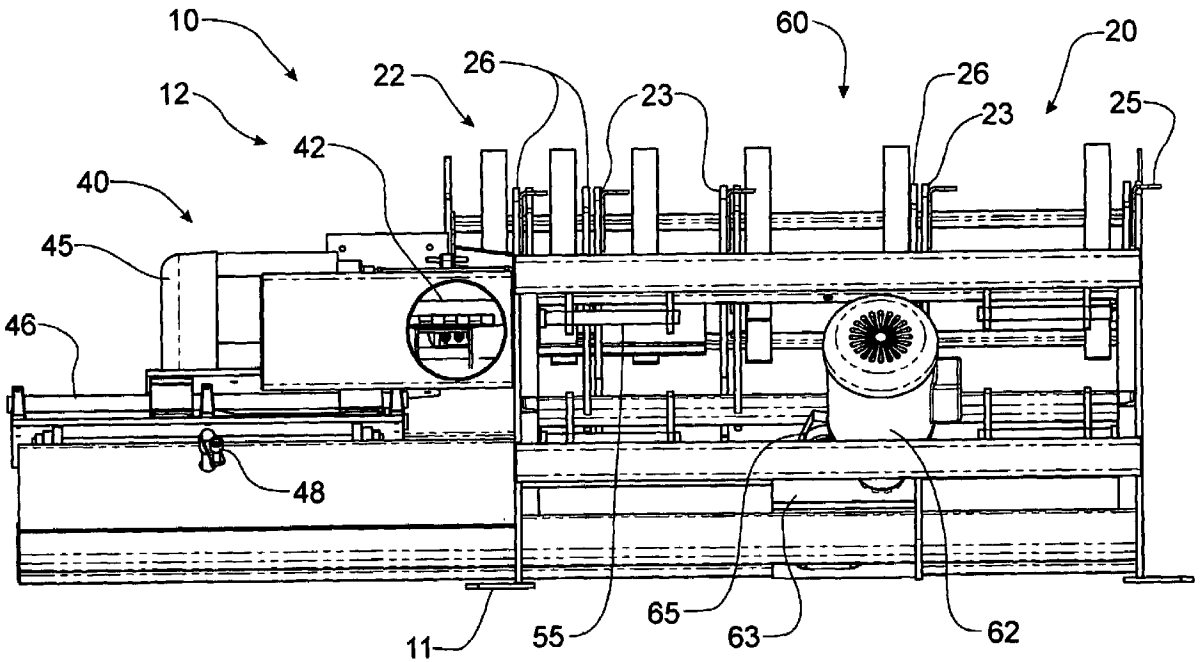
FIG. 2 is a side elevational view of the wooden stake sharpening machine shown in FIG. 1, looking at the delivery side of the machine where the sharpened stakes are collected for shipment.
Figure 3:
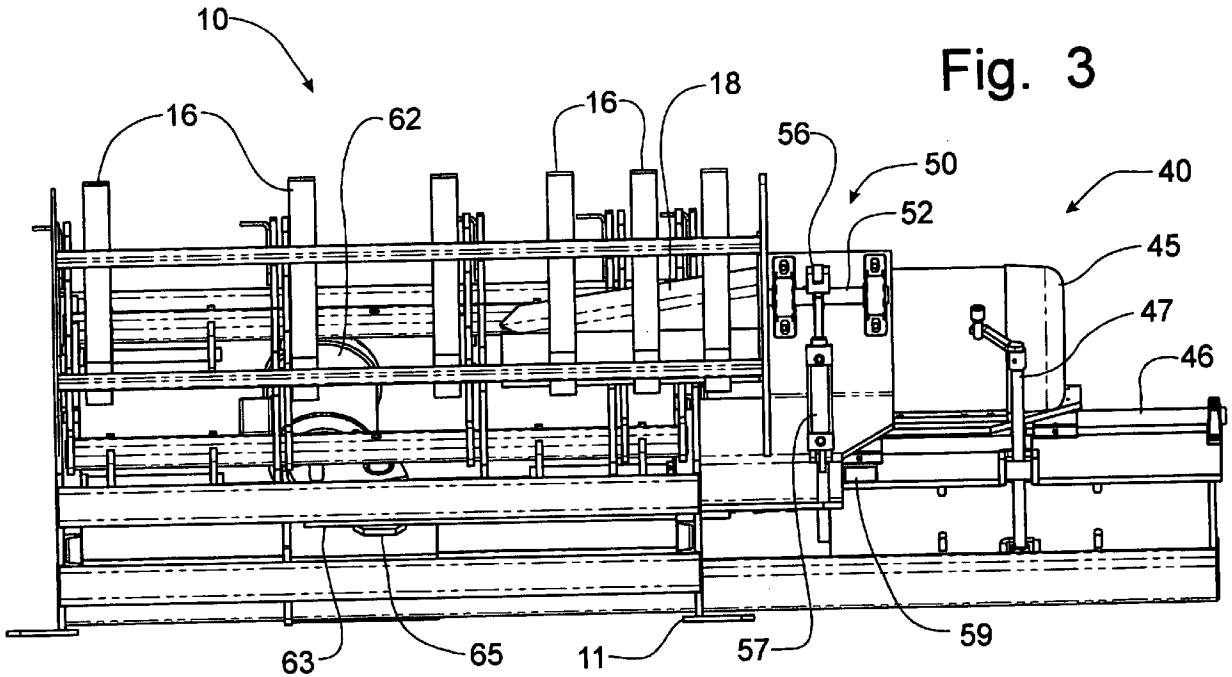
FIG. 3 is a side elevational view of the feed side of the wooden stake sharpening machine shown in FIG. 1.
Figure 4:
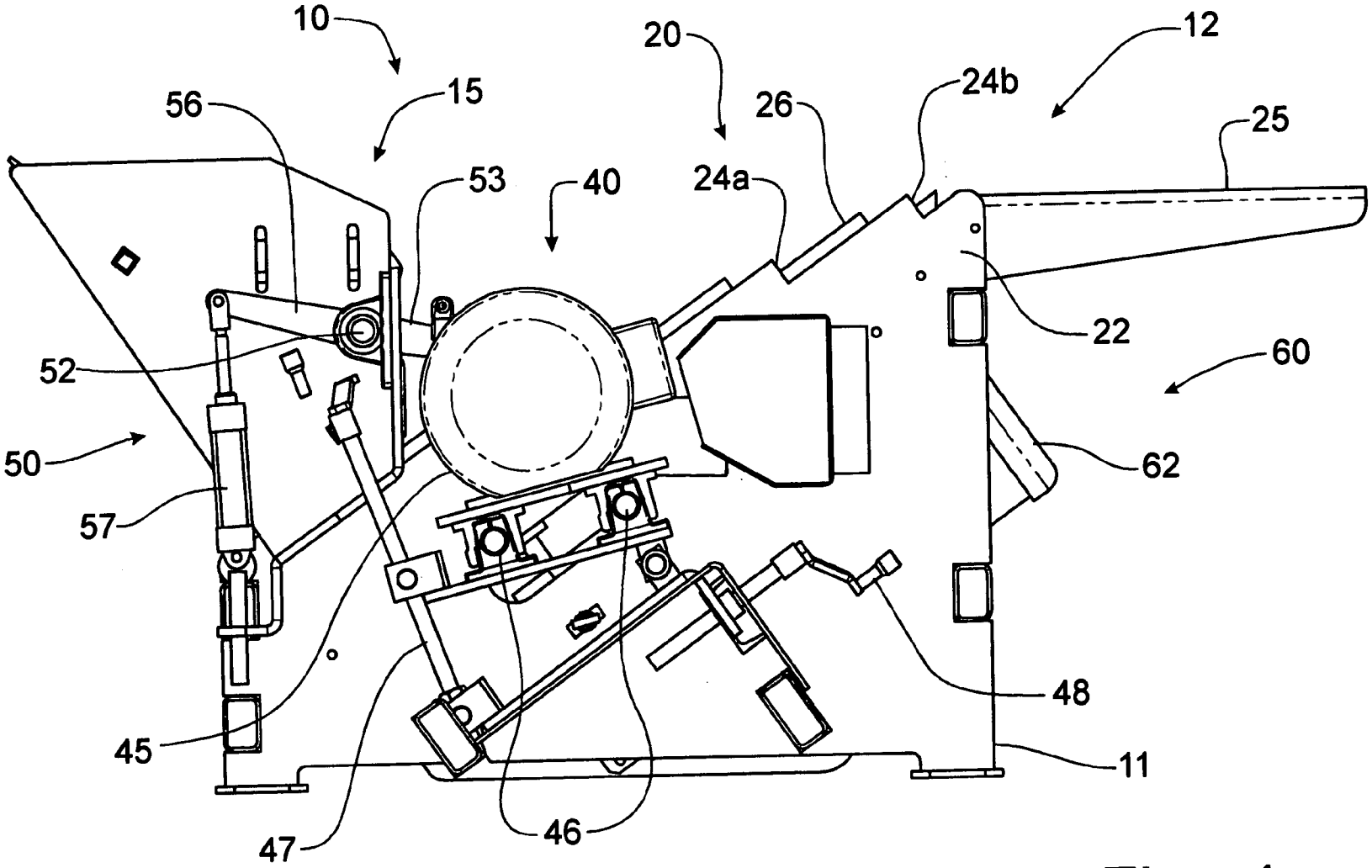
FIG. 4 is an end elevational view of the wooden stake sharpening machine shown in FIG. 1, looking at the motor for powering the operation of the cutting head.
Figure 5:
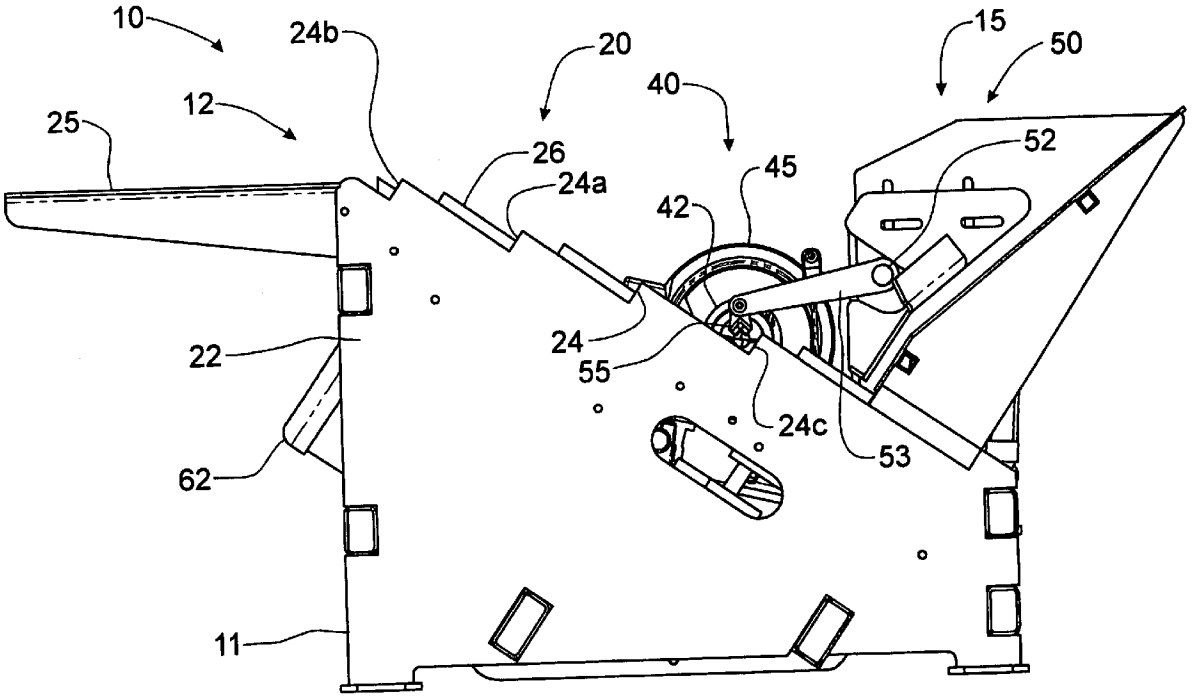
FIG. 5 is an end elevational view of the wooden stake sharpening machine show in FIG. 1, but looking at the end of the machine opposite of that depicted in FIG. 4.

The drive mechanism 60 is best seen in FIGS. 1-3. The primary drive apparatus is preferably an electric motor 62, or another appropriate source of rotational power, mounted on the frame 11 of the stake sharpening machine 10. The electric motor 62 is operatively connected to a gear box 63 to distribute the rotational power provided by the electrical motor 62. A first output from the gear box 63 (not shown) is operatively connected to the conveyor fins 26 to affect the rotational cyclical motion described above relative to the base member 22 to convey the stake blanks from the bottom of the supply bin 15 to the base member 22 for sharpening, and then upwardly along the base member fins 23 after the stakes have been sharpened, as described in detail above.

The second output from the gear box 63 is a crank 65 that rotates at the same rotational speed as the first output rotating the conveyor fins 26. The crank 65 is connected via a pivoted connecting arm 67 to the cutterhead 40 to cause reciprocal linear movement of the cutterhead 40 along the rails 46 as the crank 65 is rotated by the electric motor 62. Thus, the reciprocating movement of the cutterhead 40 is timely to the operation of the conveyor fins 26, as will be described in detail below. The operative power for operating the movable components of the machine 10 are delivered by the electrical motor 45 driving the rotation of the chipping device 42, the electrical motor 62 driving the cyclical motion of the conveyor 20 and the cutterhead 40, and the linear actuator 57, preferably a pneumatic cylinder, driving the operation of the clamping apparatus 50. As one of ordinary skill in the art will recognize, the stake sharpening machine 10 is constructed in a simple manner with a minimal number of moving parts that will provide an automated process for the sharpening of stake blanks.

Looking at all of the drawings, but particularly to the schematic representations in FIGS. 7-14, the operation of the machine 10 can best be seen. Wooden stake blanks B are preferably stacked into the supply bin 15 in a manner for efficient engagement at the bottom of the supply bin 15 so that the conveyor find 26 can move the lowermost stake blank B through the opening 19 at the bottom of the supply bin 15, as can be seen in FIGS. 7 and 8. The conveyor fins 26, with the circular motion described in detail above, deposits the stake blank B on the first saw tooth stop 24 of the base member fins 23. As the conveyor fins 26 are cycling through the motion shown in FIG. 6*a*, the drive mechanism 60 is pulling the cutterhead 40 toward the stake blank B. Once the conveyor fins 26 have deposited the stake blank B on the lowermost saw tooth stop 24*c*, between the positions 35 and 37 depicted in FIG. 6*c*, the crank 65 has moved the cutterhead 40 toward the stake blank B.

Figure 11:
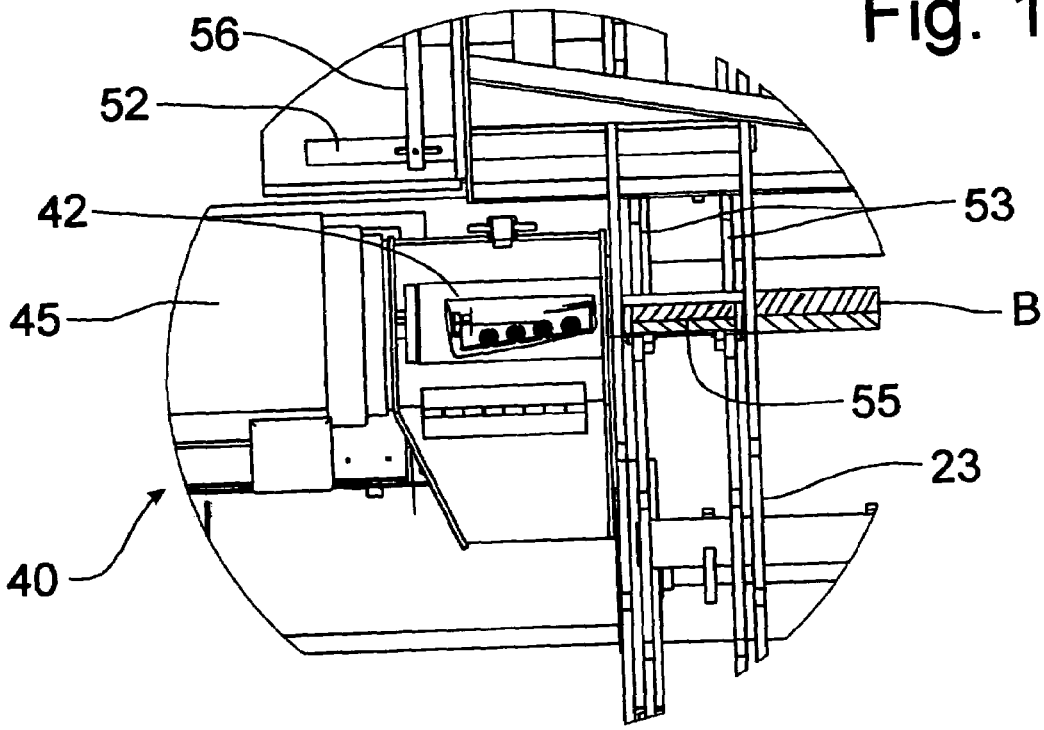
FIG. 11 is a partial top plan view of the sharpening station and surrounding structure with the cutterhead moving toward the sharpening station to engage the chipping device with the exposed end of the wooden stake blank.

Continued movement of the drive mechanism 60 pulls the cutterhead 40 along the rails 46 into engagement with the trip switch 59, which initiates the expansion of the linear actuator 57 and the resultant clamping of the stake blank B against the lowermost saw tooth stop 24*c* on the base member fins 23, as is depicted in FIGS. 9 and 10. At about this point in the cycle, the conveyor fins 26 have pushed any sharpened stakes on the delivery table 25 outwardly to permit the deposit of the next sharpened stake S onto the delivery table 25 at the position 37 shown in FIG. 6*c*. Continued movement of the drive mechanism 60 pulls the chipping device 42 into engagement with the end of the clamped stake blank B, as is depicted in FIG. 11, to cause the removal of material therefrom for the formation of the pointed end, as is demonstrated in FIG. 12. While the chipping device is preferred to be continually rotating through power delivered by the electric motor 45, a secondary switch (not shown) could be installed at an appropriate location along the rails 46 to start and stop the rotation of the chipping device 42 so that the chipping device is only rotated while engaged with the stake blank B. While such an operation may saved may save on electrical power, the possible detrimental tradeoff may be the increased wear and tear on the electric motor 45 and the chipping device 42.

Figure 12:
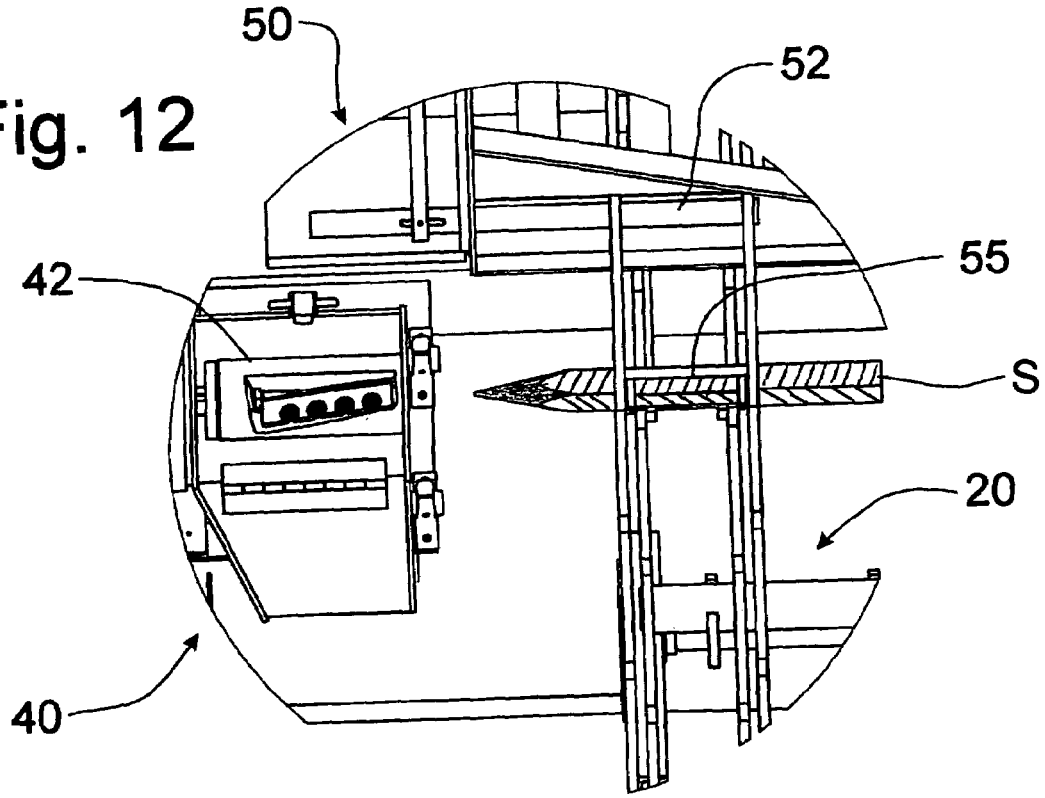
FIG. 12 is a partial top plan view of the sharpening station and surrounding structure with the cutterhead now moving away from the sharpening station and exposing the pointed end of the sharpened stake which remains clamped by the clamping mechanism since the trip switch has not yet been released.

As the drive mechanism 60 cycles the conveyor fins 26 through the lower part of the drive cycle from the position 37 through to the position 39 and then position 31, the crank 65 pulls the chipping device 42 into engagement with the stake blank B and then away from the now sharpened stake S, as is shown in FIG. 12. As the cutterhead 40 passes the trip switch 59 on the return trip away from the sharpened stake S, the clamping mechanism 50 is disengaged, as is reflected in FIG. 13, to allow the conveyor fins 26 to engage the sharpened stake S at position 31 and lift the sharpened stake onto the next saw tooth stop 24, which is shown in FIG. 14. As the newly sharpened stake S is being moved onto the next saw tooth stop 24, a new stake blank B is being moved from the bottom of the supply bin 15 and deposited onto the lowermost saw tooth stop 24*c* as described above.

The cycle is repeated with each revolution of the drive mechanism 60, moving each sharpened stake S upwardly along the base member fins 23 until reaching the delivery table 25 where the sharpened stakes can be collected for shipment or further handled by stacking and packaging machinery (not shown). At full capacity, the machine 10 is capable of sharpening up many stake blanks per hour, while providing an automated process that requires only a single operator to load stake blanks into the supply bin 15 and to remove sharpened stakes from the delivery table 25.

The invention of this application has been described above both generically and with regard to specific embodiments. Although the invention has been set forth in what is believed to be the preferred embodiments, a wide variety of alternatives known to those of skill in the art can be selected within the generic disclosure. The invention is not otherwise limited, except for the recitation of the claims set forth below.

Having thus described the invention, what is claimed is:

1. A machine for forming a point on wooden stakes, comprising:

a frame;

a supply bin supported on said frame for holding a quantity of unsharpened wooden stake blanks;

a conveyor system supported on said frame to move said stake blanks from said supply bin in a direction transverse to a longitudinal axis of said stake blanks onto a sharpening station where said stake blanks are formed with said point, said conveyor system further being operable to leave said stake blanks in a stationary position at said sharpening station before moving sharpened stakes in said transverse direction from said sharpening station to a delivery station after said point has been formed;

a clamping apparatus supported on said frame to clamp said stake blank at said sharpening station while said stake blank is in said stationary position;

a cutterhead mounted on said frame for axial movement with respect to said stake blank toward and away from said sharpening station for engagement with said stake blank clamped onto said sharpening station to form said point thereon while being held in said stationary position, said cutterhead forming said point while said stake blank is in transit from said supply bin to said delivery station; and a drive mechanism supported on said frame for powering the operation and movement of said cutterhead, the operation of said conveyor, and the operation of said clamping apparatus.

2. The machine of claim 1 wherein said conveyor system includes a walking beam conveyor operable to sequentially move a stake blank from said supply bin along said transverse direction onto said sharpening station, and then along said frame in said transverse direction after said point is formed thereon by said cutterhead to a delivery table spaced from said sharpening station.

3. The machine of claim 2 wherein said drive mechanism includes a first motor providing rotational power to said conveyor, said cutterhead being operatively connected to said conveyor so that the axial movement of said cutterhead is timed to the movement of said conveyor.

4. The machine of claim 3 wherein said first motor is connected to a gear box to transfer rotational motion to said conveyor and a coordinated reciprocal motion to said cutterhead.

5. The machine of claim 4 wherein said gear box includes a rotated crank connected to said cutterhead via a pivoted connecting arm to impart said axial motion to said cutterhead in conjunction with the movement of said conveyor.

6. The machine of claim 1 wherein said clamping apparatus comprises:

a linear actuator supported on said frame for movement between a contracted position and an expanded position;

a rock shaft rotatably supported on said frame;

a clamping member connected to said rock shaft by connecting members to be positioned for engagement with a stake blank located on said sharpening station; and an actuation arm interconnecting said linear actuator and said rock shaft.

7. The machine of claim 6 wherein said clamping mechanism further comprises a trip switch supported on said frame for engagement by said cutterhead, said trip switch affecting movement of said linear actuator between said contracted position and said expanded position.

8. The machine of claim 7 wherein said cutterhead engages said trip switch during movement thereof toward said sharpening station to cause said clamping member to engage said stake blank on said sharpening station before said cutterhead forms said point thereon, said cutterhead disengaging said trip switch during movement thereof away from said sharpening station to cause said clamping member to release said sharpened stake so that said conveyor can move said sharpened stake toward said delivery station.

9. The machine of claim 8 wherein said cutterhead includes a conical chipping device rotatably mounted to engage said stake blank to form said point thereon, said drive mechanism including a second motor operably connected to said chipping device to power the rotation thereof, said second motor being mounted for axial movement with said chipping device.

10. The machine of claim 9 wherein said frame includes slide rails arranged to support said cutterhead for said axial movement toward and away from said sharpening station, said trip switch being mounted on one of said slide rails.

11. A method of forming a point on wooden stakes, comprising the steps of:

delivering a stake blank from a supply bin along a direction transverse to a longitudinal axis of said stake blank to a sharpening station;

clamping said stake blank against said sharpening station to prevent movement thereof;

moving a cutterhead in an axial direction relative to said stake blank into engagement with said clamped stake blank to form said point thereon and create a sharpened stake while said stake blank is stationarily located on said sharpening station as part of a process of moving said stake blank transversely from said supply bin to a delivery station; and conveying said sharpened stake along said transverse direction to said delivery station after said cutterhead has disengaged said sharpened stake.

12. The method of claim 11 wherein said moving step includes the steps of:

reciprocating said cutterhead toward and away from said sharpening station; and engaging said stake blank by said cutterhead when said cutterhead is moved to said sharpening station to form said point thereon.

13. The method of claim 12 wherein said clamping step includes the steps of:

depressing a trip switch by said cutterhead during said reciprocating step toward said sharpening station;

actuating a linear actuator to move a clamping member into engagement with said stake blank while said trip switch is depressed;

opening said trip switch by said cutterhead during said reciprocating step away from said sharpening station; and releasing said sharpened stake by disengaging said clamping member from said sharpened stake while said trip switch is opened.

14. The method of claim 13 wherein said delivering step and said conveying step are accomplished with a walking beam conveyor that affects said delivering step and said conveying step simultaneously.

15. The method of claim 14 wherein said walking beam conveyor is operably driven by a first motor having an rotational output connected to said walking beam conveyor and to said reciprocating cutterhead so that the movements of said cutterhead and said conveyor are coordinated on a cyclical basis, said engaging step occurring while said walking beam conveyor is affecting said delivering and conveying steps.

16. In a stake sharpening machine having a frame, a conveyor supported on said frame and being operable to move stake blanks to be sharpened into sharpened stakes, a cutterhead engagable with said stake blanks to form a point thereon to create said sharpened stakes, and a clamping apparatus for restraining movement of said stake blank while engaged with said cutterhead to form said point thereon, the improvement comprising:

said cutterhead being mounted on said frame for reciprocal movement along an axial direction said cutterhead moved relative to said stake blank into engagement with said stake blank while said stake blank is being clamped by said clamping apparatus at a sharpening station as said stake blank is being conveyed from a supply station to a delivery station along a direction that is transverse to a longitudinal axis of said stake blanks.

17. The stake sharpening machine of claim 16 wherein said clamping apparatus comprises:

a linear actuator supported on said frame for movement between a contracted position and an expanded position;

a rock shaft rotatably supported on said frame;

a clamping member connected to said rock shaft by connecting members to be positioned for engagement with a stake blank located on said sharpening station; and an actuation arm interconnecting said linear actuator and said rock shaft.

18. The stake sharpening machine of claim 17 wherein said clamping mechanism further comprises a trip switch supported on said frame for engagement by said reciprocating cutterhead, said trip switch affecting movement of said linear actuator between said contracted position and said expanded position, said cutterhead engaging said trip switch during movement thereof toward said sharpening station to cause said clamping member to engage said stake blank on said sharpening station before said cutterhead forms said point thereon, said cutterhead disengaging said trip switch during movement thereof away from said sharpening station to cause said clamping member to release said sharpened stake so that said conveyor can move said sharpened stake toward said delivery station.

19. The stake sharpening machine of claim 18 wherein said conveyor is a walking beam conveyor operable to sequentially move a stake blank from a supply bin mounted on said frame onto said sharpening station, and then move the sharpened stake along said frame after said point is formed thereon by said cutterhead to a delivery table.

20. The stake sharpening machine of claim 19 further comprising a drive mechanism operable to power the movement of said conveyor and to cause said reciprocal movement of said cutterhead in a coordinated manner with said movement of said conveyor, said drive mechanism including a rotated crank connected to said cutterhead via a pivoted connecting arm to impart said reciprocal motion to said cutterhead in conjunction with the movement of said conveyor.

* * * * *